US006161306A

United States Patent [19]

Clodic

[11] Patent Number: 6,161,306

[45] Date of Patent: Dec. 19, 2000

[54] METHOD AND APPARATUS FOR DRYING A LOAD OF MOIST FIBROUS MATERIAL, PARTICULARLY A LOAD OF LAUNDRY

[75] Inventor: Denis Clodic, Paris, France

[73] Assignee: A.R.M.I.N.E.S - Association pour la Recherche et le Development des Methodes et Processus Industriels, Paris Cedex, France

[21] Appl. No.: 09/142,014

[22] PCT Filed: Mar. 7, 1997

[86] PCT No.: PCT/FR97/00408

§ 371 Date: Aug. 31, 1998

§ 102(e) Date: Aug. 31, 1998

[87] PCT Pub. No.: WO97/33032

PCT Pub. Date: Sep. 12, 1997

[30] Foreign Application Priority Data

Mar. 7, 1996 [FR] France ..... 96 02895

[51] Int. Cl.[7] ..... F26B 5/08

[52] U.S. Cl. ..... 34/321; 34/327; 34/425; 34/449; 34/552; 34/90; 34/596; 34/138

[58] Field of Search ..... 34/320–328, 418–425, 34/443–454, 499–500, 549, 72–73, 90, 108, 122, 138, 130–132, 595–596, 552

[56] References Cited

U.S. PATENT DOCUMENTS

| | | | |
|---|---|---|---|
| 3,758,996 | 9/1973 | Bowser | 52/172 |
| 3,791,910 | 2/1974 | Bowser | 161/45 |
| 4,282,015 | 8/1981 | Bartoschek et al. | 55/179 |
| 4,385,450 | 5/1983 | Thomas et al. | 34/21 |
| 4,391,602 | 7/1983 | Stichnoth et al. | 8/149.1 |
| 4,702,014 | 10/1987 | Karrer | 34/15 |
| 4,763,425 | 8/1988 | Grennan | 34/48 |
| 5,228,211 | 7/1993 | Stubbing | 34/22 |
| 5,430,956 | 7/1995 | Lange | 34/408 |
| 5,477,623 | 12/1995 | Tomizawa et al. | 34/58 |
| 5,711,086 | 1/1998 | Stubbing | 34/77 |
| 5,827,329 | 10/1998 | Champeau | 8/142 |
| 5,911,937 | 6/1999 | Hekal | 264/255 |

FOREIGN PATENT DOCUMENTS

| | | |
|---|---|---|
| 443672 | 3/1936 | United Kingdom . |
| WO 89/04392 | 5/1989 | WIPO . |

*Primary Examiner*—Denise L. Ferensic
*Assistant Examiner*—Andrea M. Joyce
*Attorney, Agent, or Firm*—Young & Thompson

[57] ABSTRACT

A method and an apparatus is described for drying a load of moist fibrous material, particularly a load of laundry washed and placed in a washer/drier machine or a clothes drier, wherein a closed-circuit flow of superheated steam at 102–180° C. and substantially at atmospheric pressure is passed through the load of fibrous material. The method is characterized in that, prior to the superheated steam drying step, the air in the closed circuit is flushed therefrom with steam.

10 Claims, 1 Drawing Sheet

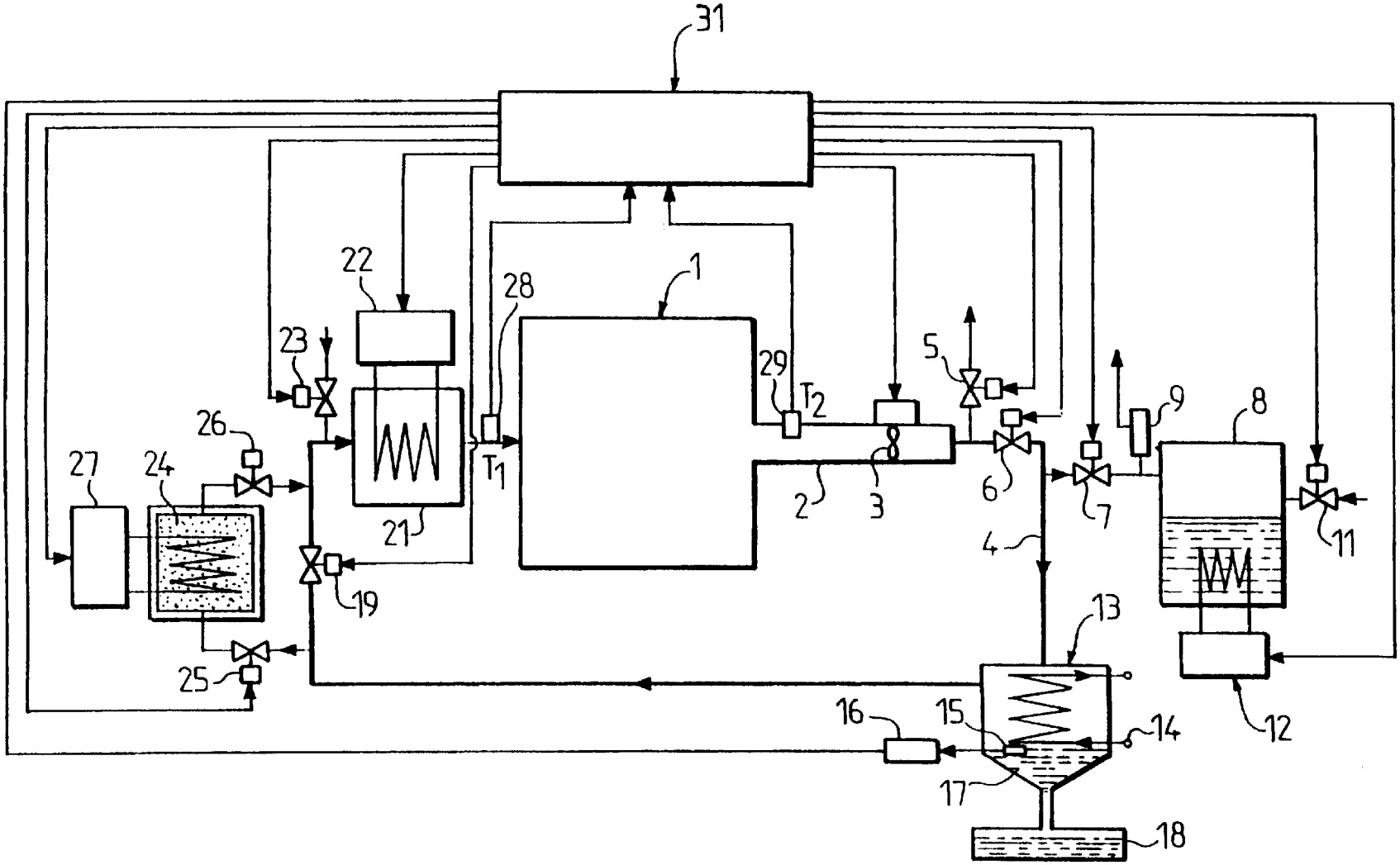
31
1
2
3
4
5
6
7
8
9
11
12
13
14
15
16
17
18
19
21
22
23
24
25
26
27
28
29
T1
T2

METHOD AND APPARATUS FOR DRYING A LOAD OF MOIST FIBROUS MATERIAL, PARTICULARLY A LOAD OF LAUNDRY

CROSS REFERENCE TO RELATED APPLICATION

This is the 35 USC 371 National Stage of International application PCT/FR97/00408 filed on Mar. 7, 1997, which designated the United States of America.

FIELD OF THE INVENTION

The present invention relates to a method and an apparatus for drying a load of moist fibrous material, particularly a load of laundry washed and placed in a washer/drier machine or a clothes drier.

BACKGROUND OF THE INVENTION

In heretofore known clothes driers, various hot fluids have been used as drying means. In particular, hot air has been employed, blown inside a clothes drier, at a temperature of the order of 120° C., but such a method of drying presents the drawback of being particularly long and of consuming a considerable amount of energy. To overcome this drawback, it has already been envisaged to use, for drying laundry, superheated steam placed in forced circulation through an enclosure containing the laundry to be dried.

Document WO No. 89/04392 discloses a method and an apparatus for drying, a load of laundry contained in an enclosure, by means of superheated steam. The superheated steam is made to circulate through the enclosure, in closed circuit, by means of a fan mounted upstream of the enclosure and downstream of a source of heat so as to deliver into the enclosure the steam evaporating from the laundry. At the beginning of a drying cycle, the air contained in the enclosure is delivered via a vent to which a condenser is connected in by-pass.

Document EP-A-0 026 707 discloses a method and an apparatus for drying, in which the drying cycle comprises a first spinning phase in which there is circulated through an enclosure, containing the material to be dried, steam produced by an independent steam generator, and a second phase in which there is circulated, by means of a fan connected upstream of the enclosure, the steam evaporated from the moist material, this steam passing through a superheater. A condenser is connected in by-pass at the outlet of the enclosure containing the moist material.

SUMMARY OF THE INVENTION

The present invention relates to improvements in the known methods and apparatus, making it possible in particular to reduce the overall time for drying a load of fibrous material and to considerably reduce the cost of the drying apparatus.

To that end, this method of drying a load of moist fibrous material, particularly a load of moist laundry after washing, in which there is passed through the load of fibrous material, in closed circuit, superheated steam at a temperature included between 102° and 180° C. and substantially at atmospheric pressure, characterized in that it comprises, prior to the superheated steam drying step, a previous phase of flushing the air present in the closed circuit by means of steam.

The invention also has for an object an apparatus for drying a load of moist fibrous material, particularly a load of moist laundry after washing, comprising an enclosure in which is housed the load of moist laundry, a steam generator, a superheater, a condenser, and a fan for circulating in a principal pipe in closed circuit, superheated steam at a temperature ranging from 102° C. to 180° C., through the enclosure and the load of moist fibrous material that it contains, characterized in that the fan provided to ensure circulation of the steam is constituted by an exhauster fan connected, on the principal pipe, downstream of the outlet of the enclosure, in order to create a slight depression in this enclosure, the condenser and the superheater are connected in series upstream of the enclosure, the principal pipe is connected, towards the delivery of the fan, on the one hand to a first electrovalve for communication with the open air, connected in by-pass, and on the other hand to a second electrovalve connected in series and the steam generator is connected to the principal pipe, downstream of the second electrovalve, via a third electrovalve.

The method and the apparatus for drying according to the invention offer the advantage of enabling the apparatus to be simplified. In effect, the prior rinsing of the closed circuit of its air, by means of the steam, before the drying phase proper, allows the apparatus to operate at atmospheric pressure and the temperautre of the steam inside the drying enclosure is therefore obligatorily always greater than 100° C. for normal atmospheric pressure. The cost of a clothes drier according to the invention may thus be considerably reduced as it is not necessary to use sophisticated sealing devices (water-tight seals, etc . . . ).

BRIEF DESCRIPTION OF THE DRAWINGS

A form of embodiment of the present invention will be described hereinafter by way of a non-limiting example with reference to the accompanying drawings, of which the single FIGURE is a diagram of an apparatus for drying laundry by means of superheated steam, according to the invention.

DETAILED DESCRIPTION OF THE INVENTION

The drying apparatus comprises an enclosure 1 in which is placed the load of fibrous material to be dried which, within the framework of the present description, will be considered as being moist laundry, as after washing. The enclosure 1 may be constituted by a drum rotated by mechanical drive and adapted to rotate alternately in the two directions, so as to move the laundry. The enclosure 1 may also be constituted by a clothes drier in which the pieces of laundry are immobile, being suspended in an appropriate manner. The enclosure 1 may also be of the type with continuous circulation of pieces of laundry, from an inlet of the enclosure 1 to the outlet.

The enclosure 1 is connected to an outlet conduit 2 in which is housed a turbo exhauster fan 3 creating a depression in the enclosure 1 when it is switched on. The outlet conduit 2 is connected to a principal pipe 4 connected in a closed principal circuit with, the enclosure 1 and connected to that end to an inlet orifice of this enclosure. This principal pipe 4 is intended for the circulation, in the closed principal circuit, of superheated steam and/or air, as will be specified hereinafter. To pipe 4 there is connected, downstream of the fan 3, an electrovalve 5 also forming a valve for communication with the open air, calibrated for example at a pressure of 1.05 bar absolute. Downstream of the point of connection of the electrovalve 5 there is connected another electrovalve 6, in series in the pipe 4, and downstream of this electrovalve 6 is branched in by-pass another electrovalve 7 connected to the upper part of a steam generator 8. On the pipe connecting the electrovalve 7 to the steam generator 8 there is connected a safety valve 9 calibrated at a pressure of 1.2 bar absolute for example. The steam generator 8 is connected to a source of water via a valve 11 and it comprises an electrical heating device 12 for provoking the vaporization of the water contained in the generator 8.

On pipe 4 is connected in series, downstream of the steam generator 8, a steam condenser 13 provided with an air or water cooling circuit 14. The condenser 13 is adjusted so that the temperature of condensation is always slightly greater than the temperature of saturation corresponding to atmospheric pressure, i.e. 100° C. for a normal atmospheric pressure. The condenser 13 contains a float 15 connected to a level sensor 16 detecting the level of water in a condensate recuperator 17 located in the lower part of the condenser 13. Below the condensate recuperator 17 there is located a condensate tank 18.

After the condenser 13, i.e. downstream in the direction of circulation of the steam, the principal pipe 4 in the closed principal circuit comprises an electrovalve 19 connected in series. The pipe 4 is then connected to the inlet of a superheater 21. This superheater 21 comprises an electrical heating circuit 22 producing superheating of the steam to a temperature ranging from 102° C. to 180° C. Upstream of the superheater 21, an electrovalve 23 is connected to pipe 4 to allow an admission of air in the principal circuit.

According to a variant, the steam generator 8 might be associated with the superheater 21, forming one and the same unit supplying superheated steam from liquid water.

The apparatus may also comprise a dehydrator 24 connected in parallel on the electrovalve 19 and connected to the principal pipe 4, on either side of the electrovalve 19, by two electrovalves 25 and 26. The dehydrator 24 comprises a matrix of dehydrating material, capable of absorbing or adsorbing the steam and able to be regenerated by heating by means of an electrical heating device 27.

The temperature of the fluid (steam and/or air) flowing in the principal circuit is monitored by means of two temperature probes 28, 29 mounted respectively at the inlet and at the outlet of the enclosure 1, in order to detect the inlet temperature T1 and outlet temperature T2 of the steam passing through the enclosure 1.

The various electrovalves 5, 6, 7, 11, 19, 23, 25, 26, the heating device 12 of the steam generator 8, the heating circuit 22 of the superheater 21 and the heating device 27 of the dehydrator 24, are connected to a general automatic control device 31 which adjusts the functioning of the apparatus. This device 31 is also connected to the turbo exhauster 3 to control start and stop of this fan. The device 31 also receives information coming from the level sensor 16 of the condenser 13 and from the temperature probes 28 and 29.

The functioning of the apparatus carrying out the method of drying according to the present invention will now be described.

In the case of a discontinuous method, i.e. of drying of successive batches of laundry, the method of drying comprises a first phase during which the moist air normally present in the principal circuit is replaced by steam, superheated or not, circulating in open circuit. This moist air is located in the enclosure 1 and the rate of humidity and the temperature of this air are variable. At the beginning of the first phase, the automatic control device 31 provokes several simultaneous operations, namely the switching on of the steam generator 8, so as to produce in this generator steam at a temperature of 102° C., the opening of the electrovalves 5 and 7, the closure of the electrovalve 6, the switching on of the fan 3 and possibly the switching on of the superheater 21. The fan 3 creates a depression inside the enclosure 21, so that the steam produced by the steam generator 8 flows successively through the open electrovalve 7, the principal pipe 4, the condenser 13, of which the external cooling system is stopped during this phase, and the open electrovalve 19 and it is introduced in the superheater 21 then in the enclosure 1 and this steam flushes out the air contained in the principal circuit and in the enclosure 1, this air being delivered to the outside, jointly with the steam, through the open electrovalve 5. This first phase of flushing and of replacement of the moist air by steam, possibly superheated, lasts a predetermined time which may easily be calculated from the known volume of the apparatus. At the end of this first phase, only steam, superheated or not, circulates in the principal pipe 4, at atmospheric pressure, and the principal circuit no longer contains air. At that moment, the automatic control device 31 provokes closure of the electrovalves 5, 7, the stop of the steam generator 8 and the opening of electrovalve 6, this establishing a closed circuit for the subsequent circulation of steam.

The method of drying then passes to a second phase or principal phase during which the laundry contained in the enclosure 1 is dried by the superheated steam and the water extracted from the laundry is condensed in continuous manner in the condenser 13. At the beginning of this second phase, the automatic control device 31 provokes operation of the superheater 21, if it were not already operating during the first phase of flushing of the air. During the principal phase of drying, the fan 3 continues to rotate, producing the circulation in closed circuit of the steam which is superheated in the superheater 21. In the condenser 13, a part of the steam condenses and the condenser thus withdraws a progressively increasing quantity of water from the closed circuit, allowing optimal functioning of the clothes drier. The power of the condenser 13 is servo-controlled by the outlet temperature T2 of the steam of the enclosure 1. In fact, as drying progresses, the flow rate of water extracted from the laundry decreases, the temperature T1 increases and the power of the condenser 13 decreases. The level of the condensate collected in the recuperator 17 is detected by the float 15 acting on the level sensor 16. This sensor 16 makes it possible, jointly with the temperature probes 28 and 29, to determine the end of drying. In other words, when the level sensor 16 detects that the level of the condensed water in the condensate recuperator 17 virtually no longer varies and the temperature probes 28 and 29 indicate that the inlet temperature T1 and outlet temperature T2 are virtually identical, this means that the laundry has attained its final drying point. At that moment, the automatic control device 31 automatically stops the drying cycle.

The principal phase of drying with the aid of superheated steam may possibly be followed by a third phase of drying by means of dry air.

What is claimed is:

1. Method of drying a load of moist fibrous laundry material after washing, contained in a circuit containing moist air, the method comprising the following two successive phases:

a first phase of flushing and replacement of the moist air present in the circuit with steam whereby air is withdrawn from the circuit and released to the atmosphere; and a second drying phase of passing superheated steam at a temperature ranging between 102° C.–180° C. and substantially at atmospheric pressure through the load of fibrous laundry material, in closed circuit.

2. Apparatus for drying a load of moist fibrous material, comprising:

an enclosure for housing the load of moist fibrous material, said enclosure having an outlet and an inlet connected in a closed circuit containing moist air with a principal pipe;

heating means for producing steam, connected to said principal pipe upstream of the inlet of said enclosure; said heating means being structured and arranged to produce a) steam during a first phase of flushing and replacement of the moist air by steam, and b) superheated steam at a temperature ranging from 102° C. to 180° C. and substantially at atmospheric pressure during a subsequent second drying phase;

an exhaust fan connected on said principal pipe for circulating steam during the first phase of flushing the moist air, and thereafter for circulating superheated steam during the second drying phase through the principal pipe and the enclosure;

selective communication means operatively associated with the circuit for venting to the outside, during said first phase, the air content in the moist air; and condensing means connected to said principal pipe for condensing a part of the steam.

3. The apparatus according to claim 2, wherein said heating means comprise a steam generator and a superheater connected to said principal pipe upstream of the inlet of said enclosure, and said selective communication means comprise:

a first electrovalve for communication with ambient air;

a second electrovalve connected in series on said principal pipe downstream of the fan and downstream of the enclosure; and a third electrovalve for communication with the steam generator;

said first electrovalve being connected in by-pass to said principal pipe downstream of the fan and upstream of the second electrovalve; and said third electrovalve being connected in by-pass to said principal pipe downstream of the second electrovalve.

4. The apparatus according to claim 3, wherein said condensing means comprise a condensate recuperator and a level sensor for detecting condensed water collected within said condensate recuperator.

5. The apparatus according to claim 3, wherein the principal pipe comprises a fourth electrovalve connected in series on the principal pipe and a dehydrator connected in parallel to the principal pipe, on either side of the fourth electrovalve, by fifth and sixth electrovalves; the dehydrator comprising a matrix of dehydrating material which may be regenerated by heating with an electrical heating device.

6. The apparatus according to claim 3, further comprising two temperature probes mounted respectively at the inlet and at the outlet of the enclosure for detecting temperatures (T1) and (T2) of the superheated steam passing respectively through the inlet and outlet of the enclosure.

7. The apparatus according to claim 3, further comprising a seventh electrovalve connected on said principal pipe upstream of the superheater for introducing air into the principal pipe.

8. The apparatus according to claim 3, further comprising first and second temperature probes for detecting temperatures (T1) and (T2) at the inlet and the outlet of the superheated steam, and an automatic control device operatively connected to the heating means and to the first and second temperature probes for controlling the two successive phases of flushing of the air and of drying as a function of the detected temperatures.

9. The apparatus according to claim 8, wherein the automatic control device is connected to the first, second and third electrovalves.

10. The apparatus according to claim 8, further comprising a sensor for sensing the level of condensate in the condensing means, said sensor being operatively connected to the automatic control device for controlling the two successive phases of flushing of the air and of drying as a function of the level of the condensate.

* * * * *